US007585188B2

(12) United States Patent
Regnier

(10) Patent No.: US 7,585,188 B2
(45) Date of Patent: Sep. 8, 2009

(54) EDGE CARD CONNECTOR ASSEMBLY WITH HIGH-SPEED TERMINALS

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/176,515

(22) Filed: Jul. 7, 2005

(65) Prior Publication Data

US 2006/0014438 A1 Jan. 19, 2006

Related U.S. Application Data

(60) Provisional application No. 60/586,126, filed on Jul. 7, 2004.

(51) Int. Cl.
*H01R 24/00* (2006.01)

(52) U.S. Cl. ..... 439/637

(58) Field of Classification Search ..... 439/637, 439/630, 631–636, 328, 326, 60
See application file for complete search history.

(56) References Cited

U.S. PATENT DOCUMENTS

| | | | | |
|---|---|---|---|---|
| 4,780,095 | A * | 10/1988 | Classon et al. | 439/637 |
| 5,358,411 | A | 10/1994 | Mroczkowski et al. | |
| 5,425,651 | A * | 6/1995 | Thrush et al. | 439/326 |
| 5,525,071 | A * | 6/1996 | Obara et al. | 439/326 |
| 5,895,281 | A * | 4/1999 | Rothenberger | 439/326 |
| 5,951,335 | A | 9/1999 | Kurotori et al. | |
| 5,997,315 | A | 12/1999 | Akama et al. | |
| 6,454,574 | B1 | 9/2002 | Yu | |
| 6,464,521 | B1 | 10/2002 | Kurotori et al. | |
| 6,666,702 | B1 * | 12/2003 | Pickles | 439/328 |
| 7,025,617 | B2 | 4/2006 | Regnier et al. | |
| 7,048,567 | B2 | 5/2006 | Regnier et al. | |
| 2002/0081872 | A1 | 6/2002 | Yu | |
| 2006/0009080 | A1 | 1/2006 | Regnier et al. | |
| 2006/0019525 | A1 | 1/2006 | Lloyd et al. | |
| 2006/0040556 | A1 | 2/2006 | Neer et al. | |

FOREIGN PATENT DOCUMENTS

| | | |
|---|---|---|
| EP | 1 058 351 | 12/2000 |
| WO | WO 03/096485 | 11/2003 |

OTHER PUBLICATIONS

International Search Report of International Patent Application No. PCT/US2005/024477, Oct. 25, 2005.

* cited by examiner

*Primary Examiner*—Alexander Gilman

(57) ABSTRACT

A surface mount connector for high speed data transfer application has an insulative housing with a circuit card-receiving slot disposed along a front face thereof. A plurality of conductive terminals are supported by the housing so that contact portions of the terminals extend into the card slot. The terminals are formed with a thin configuration to reduce the overall capacitance of the terminals as a group as a means of regulating the impedance thereof. The terminals are supported on opposite faces of the connector housing, specifically the top and bottom faces thereof, and each of the terminals includes a tail portion, a contact portion and a retention portion that engages the connector housing so that the contact portions are cantilevered in their extent within the housing.

38 Claims, 8 Drawing Sheets

(PRIOR ART)

EDGE CARD CONNECTOR ASSEMBLY WITH HIGH-SPEED TERMINALS

REFERENCE TO RELATED APPLICATION

This application claims priority for prior U.S. Provisional Patent Application No. 60/586,126, filed Jul. 7, 2004.

BACKGROUND OF THE INVENTION

The present invention is directed generally to edge card connectors and, more specifically to edge card connectors in which the connector impedance may be controlled by shaping of the connector terminals.

High speed data transfer systems require electrical connectors in which the electrical impedance can be controlled in order to maintain the required data transfer rate of the electrical system. It is desirable at high speed data transfer rates to obtain a specific impedance in a connector that matches the impedance of the entire electronic system, i.e., the circuits on the a circuit board of an electronic device and either the circuits of opposing electronic device or in a transmission cable. The impedance of a connector may be controlled by the spacing of the terminals, the size of the terminals and the thickness and location of material within the connector housing.

However, low profile connectors, such as those used in SFP (Small Form Factor Pluggable) and SFP-like applications are desired in electronic devices in which space is a premium and thus it is difficult to control the impedance by modifying the spacing and size of the terminals in a reduced-size connector housing. When the structure of the terminals are modified, it becomes difficult to retain all of the mechanical functions of the connector, such as terminal retention and engagement while tuning the impedance of the connector The present invention is directed to an improved electrical connector system that combines the aforementioned characteristics and which provides terminals that are capable of accommodating high data transfer speeds of approximately 2 gigabits per per second and greater.

SUMMARY OF THE INVENTION

Accordingly, it is a general object of the present invention to provide a low profile connector in which the terminals may have varying shapes for controlling the impedance of the connector.

Another object of the present invention to provide a surface mount style connector for mounting on a circuit board, the connector having a plurality of conductive terminals supported therein in spaced apart order, the terminals having stubs and slots formed as part thereof, thereby reducing and/or increasing the amount of metal to influence the capacitance and/or the inductance of the terminals and control the impedance thereof.

A further object of the present invention is to provide a right angle, low profile surface mount connector for use in high speed applications in which the connectors have a specific structure for controlling the impedance and inductance of electrical connectors.

A still further object of the present invention is to provide a small form factor connector for receiving the edge of a circuit card therein and providing a connection between circuits on the circuit card and circuits on a larger circuit boards, the connector having an insulative housing having a slot disposed therein for receiving the edge of the circuit card therein, and the housing further having two terminal insertion faces disposed therein, each of the faces including a plurality of terminal-receiving slots, the terminal-receiving slots being disposed on opposite sides of the connector to facilitate insertion of the terminals therein.

Yet another object of the present invention is to provide a high speed connector of small form factor having an insulative housing and terminals supported by the housing along two opposing surfaces of the housing, each of the terminal including a contact portion that extends in a forward direction of the connector housing and a tail portion that extends in a rearward direction of the connector housing, each of the terminals further including a retention portion disposed intermediate the contact and tail portions thereof, the retention portion being received within individual retention cavities that extend transversely to the card-receiving slot.

Another object of the present invention is to provide a high speed connector having an insulative housing with defined top, bottom and side surfaces, the connector housing accommodating a plurality of conductive terminals that are inserted into terminal-receiving cavities disposed in the top and bottom surfaces of the connector housing, the bottom surface of the connector housing being recessed to define a recess between it and a top surface of a circuit board to which the connector housing may be mounted, the recess being sized sufficiently to receive a projection from an opposing mating connector to thereby provide a means for ensuring proper engagement between the connector housing and the opposing mating connector.

Yet a further object of the present invention is to provide a small size connector suitable for use in small form factor applications, the connector including a housing that supports a plurality of conductive terminals that are arranged in two distinct terminal sets on opposite surfaces of the connector, the terminal including surface mount feet that extend outwardly from the connector housing proximate a rear portion thereof, the terminal feet of one terminal set extending out from a first base portion of the connector housing and the terminal feet of another distinct terminal set extending out from a second base portion of the connector housing.

Still a further object of the present invention is to provide a small size connector for use in high speed data transmission applications, the connector having a slot for receiving a circuit card or a male portion of an opposing connector therein, the slot being flanked by a plurality of conductive terminals, each of the terminals including a retention member in the form of a stub that extends perpendicular to a body portion of the terminal, the stubs being sized to increase or decrease capacitance between adjacent terminals in order to firstly tune the impedance of the connector, the terminals being arranged in two distinct sets of terminals, one set of the terminals having their tail portions substantially disposed in the insulative housing of the connector and the other set of terminal having their tail portions substantially disposed in air, thereby creating two different sets of dielectric material that encompasses the terminal to secondly or further tune the impedance of the connector.

The present invention accomplishes the aforementioned and other objects by the way of its novel and unique structure. In one embodiment of the invention, a connector assembly is provided for mounting to a circuit board with surface mount technology. The connector includes a dielectric housing and terminals of a first type which are stamped from a metal strip and are inserted into slots in a front face of the connector housing. Terminals of a second type are stamped from a second metal strip and are inserted into slots along the rear face of the connector housing so the first and second type terminals are opposing each other. The first and second sets of terminals are inserted into the connector housing along two distinct faces of the housing, which are preferably on opposite ends, or sides of the housing.

The first and second type terminals have cantilevered contact arm portions that at least partially extend into an internal receptacle of the connector housing which is designed to receive the edge of a circuit card. Both the first and second types of terminals have contact portions, tail portions and interconnecting body portions. The terminal body portions also include terminal retention portions that are press fit into slots, or other cavities, that are formed in the connector housing. The terminals are inserted into the connector housing from two opposite sides of the housing, preferably the top and bottom sides of the housing. Using this connector housing structure, the terminal may be reduced in size, yet still maintain their overall cantilevered configuration. The tail portions of the terminals of this embodiment include surface mount feet that preferably extend at an angle so that they are oriented parallel to the circuit board. The terminals may also include through hole tails that extend at an angle to the circuit board.

Each terminal include a contact portion and a body portion that extends between the contact and tail portions. The terminals are received in terminal-receiving cavities that extend lengthwise through the connector housing in a staggered arrangement so that the terminals of one of the two distinct terminal sets are staggered with respect to the other of the two distinct terminal sets. The terminal body portions further include retention portions that preferably take the form of stubs that extend out at an angle to the body portions and the stubs are received within slots that extend at an angle, preferably inwardly of the connector housing, to the main terminal-receiving cavities of the connector housing.

The connector housing of the invention may include two distinct base portions which are spaced lengthwise apart from each other. Each of these base portions preferably supports a single set of terminals near the tail portions thereof. With this arrangement, the bottom of the connector housing may be hollowed out to form a recess that opens to the front of the connector and which is closed of by one of the two base portions at the rear of the recess. This recess is configured to receive a projection from an opposing mating connector in the form of a plug connector. This recess permits a user to ensure that the opposing mating connector will be properly inserted into and mated with the connectors of the invention. This recess does not reduce the overall structural integrity of the connectors of the invention and the location of the slots that receive the retention members also does not reduce the structural integrity of the connectors of the invention.

The two distinct base portions serve to locate the tails of the two sets of terminals in different locations. The tails of one set of terminals are positioned inwardly of a rear edge of the connector housing , while the tails of the other set of terminals are positioned proximate to the rear edge of the connector housing. The tails of the one terminal set are substantially enclosed with the material that makes up the connector housing while the tails of the other terminal set are supported mostly in air, thereby providing two different dielectric materials that enclose the terminal tail portions to thereby tune the impedance of the connector along the tail portion area thereof.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
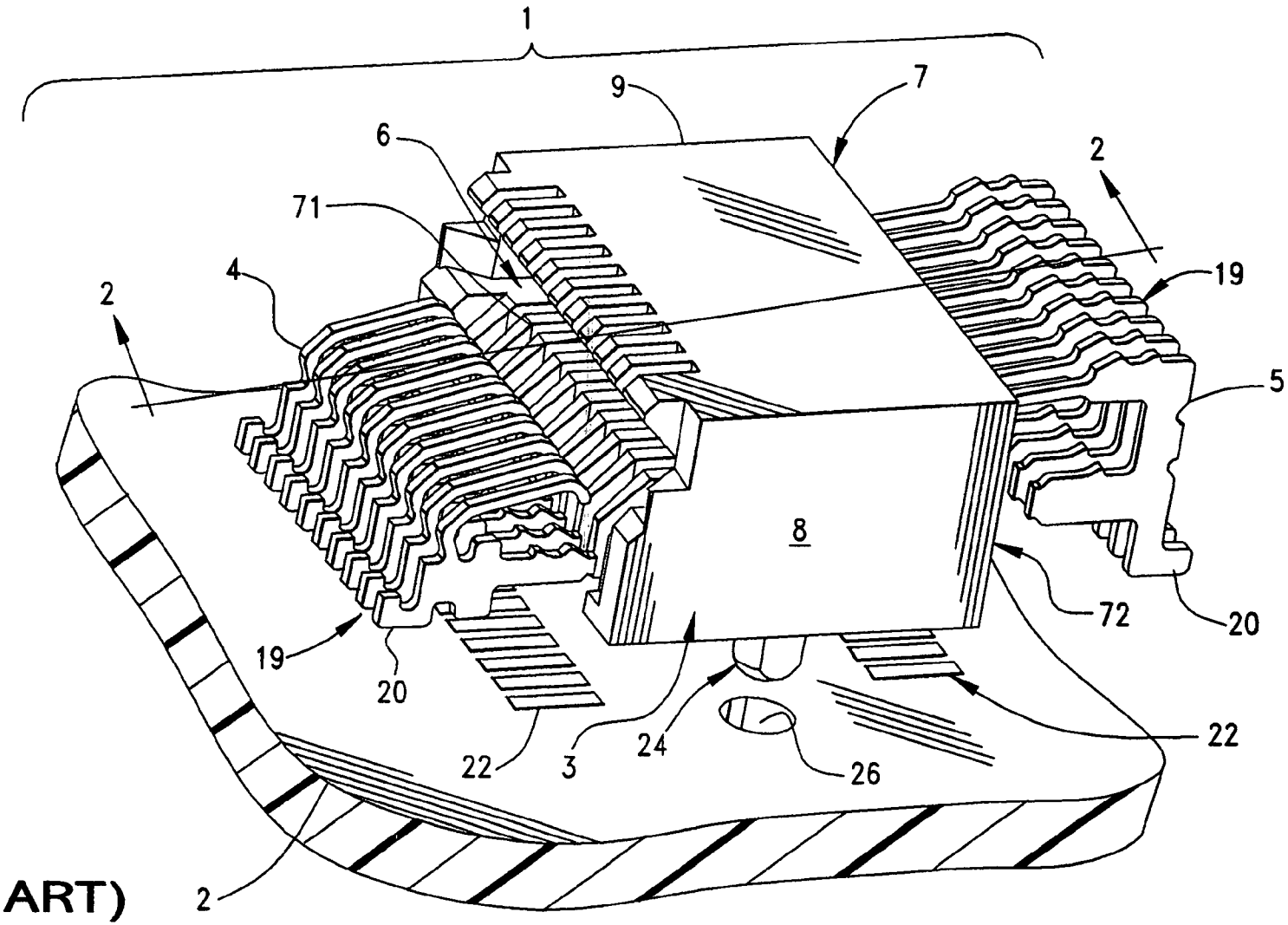
FIG. 1 (PRIOR ART)
FIG. 1 is an exploded perspective view of a known connector assembly illustrating one type of circuit board application to which the present invention is directed.

FIG. 1 illustrates a known connector assembly, generally designated as 1, that will be used to explain the environment in which the present invention operates. The connector assembly 1 is a surface-mount style and is intended for mounting to a printed circuit board 2. The connector assembly includes an insulative housing 3, preferably formed from a dielectric material, and a plurality of conductive terminals 19 are supported in the housing 3. The terminals 19 are arranged in two distinct sets of first terminals 4 and second terminals 5. The connector housing preferably has a configuration which includes a plurality of distinct faces and these faces include a first, or front face 6 and an opposing second, or rear face, 7. Side faces or sidewalls 8, 9 are seen to interconnect the front and rear faces 6, 7 of the housing together, and in the embodiment illustrated, the housing. The first face 6 of the connector housing may be considered as a mating face of the connector inasmuch as it contains a slot formed therein for receiving an edge of a circuit board or edge card therein, and the second face 7 of the connector housing may be considered as a mounting face inasmuch as a portion of the connector, by way of the rear terminals, is mounted to the circuit board 2.

The first terminals 4 are mounted into slots 71 formed in the connector housing 3 along its front face 6, while the second terminals 5 are mounted in slots 72 that are formed in the connector housing 3 along its rear face 7. The front and rear faces 6, 7 are oriented substantially perpendicular to the printed circuit board 2 onto which the connector housing 3 is mounted. Mounting portions 20 formed in the terminals 19 are located on the terminals 19 in locations spaced away from the connector housing 3 and serve as a means for connecting the terminals of the connector to corresponding conductive pads 22 formed with the circuit board 2 in a surface mount manner. These mounting portions are illustrated as conventional surface mount tails. The connector housing 3 may also include mounting pegs, or posts 24 formed therewith that are received within complementary openings 26 formed with the circuit board 2.

Figure 2:
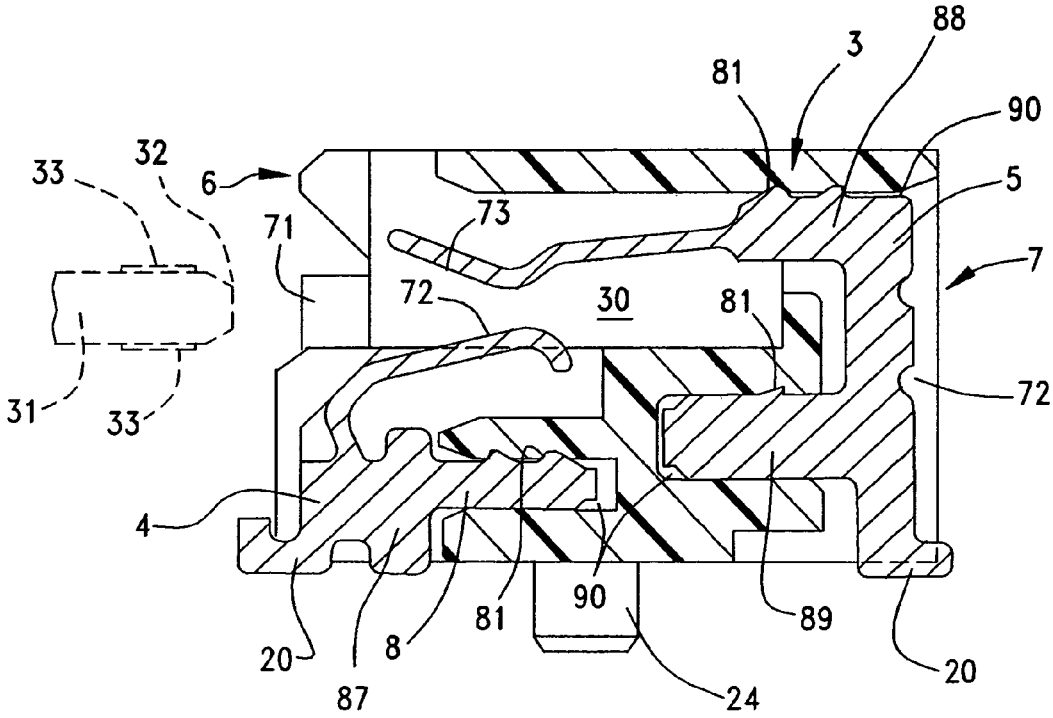
FIG.2 (PRIOR ART)
FIG. 2 is a cross-sectional view of the connector assembly of FIG. 1 taken along line 2-2 thereof, removed from the circuit board and illustrating the housing, its mating slot and the positioning of first and second terminals therein.

FIG. 2 illustrates, in cross-section, the connector housing 3 of FIG. 1. This view shows the position of the two sets of terminals 4, 5. The connector housing 3 includes an internal cavity, or receptacle 30, which receives an insertion edge 32 of an edge card 31, illustrated in phantom. The two terminals 4, 5 each have contact arm portions 72, 73 that extend in a cantilevered fashion, from body portions 87, 88, into the internal receptacle 30 along opposite sides thereof in opposition to circuit pads 33 arranged on the circuit card 31. The terminals 4, 5 may also include terminal retention portions 8, 88 & 89 which may or may not form part of the terminal body portions. These retention portions include one or more teeth or barbs, 81, that skive, or cut, into the connector housing material along the edges of the three retention slots 90 which are shown in the Figure.

Figure 3:
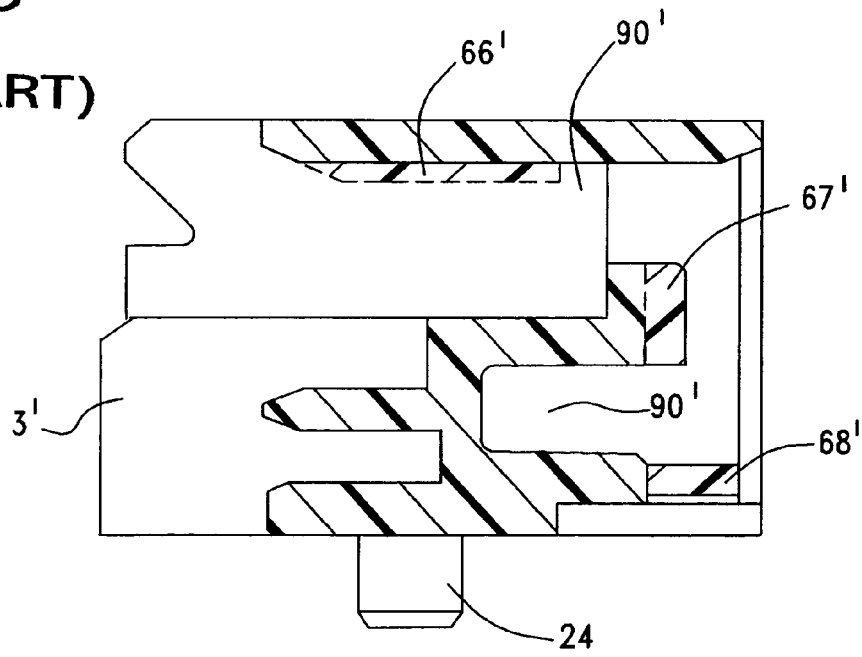
FIG.3 (PRIOR ART)
FIG. 3 is a cross-sectional view of a known connector housing.
Figure 4:
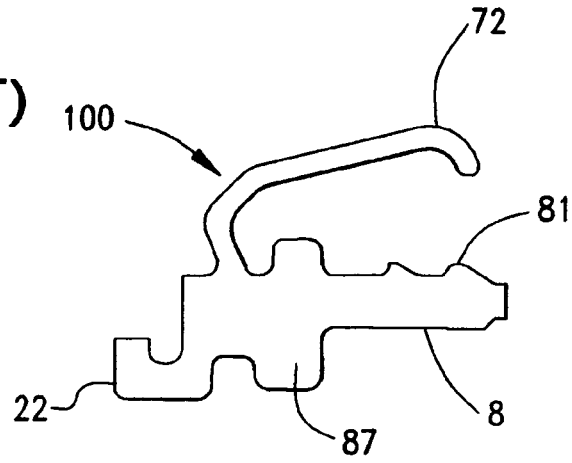
FIG.4 (PRIOR ART)
FIG. 4 is a side elevational view of a first type terminal utilized in the known connector assembly of FIG. 1.

FIG. 4 illustrates, a first type of terminal 100 that is used in the known connectors of FIG. 3. This terminal 100 is seen to have a surface mount portion 22, an elongated, cantilevered contact portion 72 that extends into a card-receiving slot of the connector, a body portion 87, and a terminal retention portion 8 that is received within a slot or cavity formed in the connector housing. Barbs 81 are provided as part of the terminal retention portion 8 to increase the retention of the terminal in the connector housing.

Figure 5:
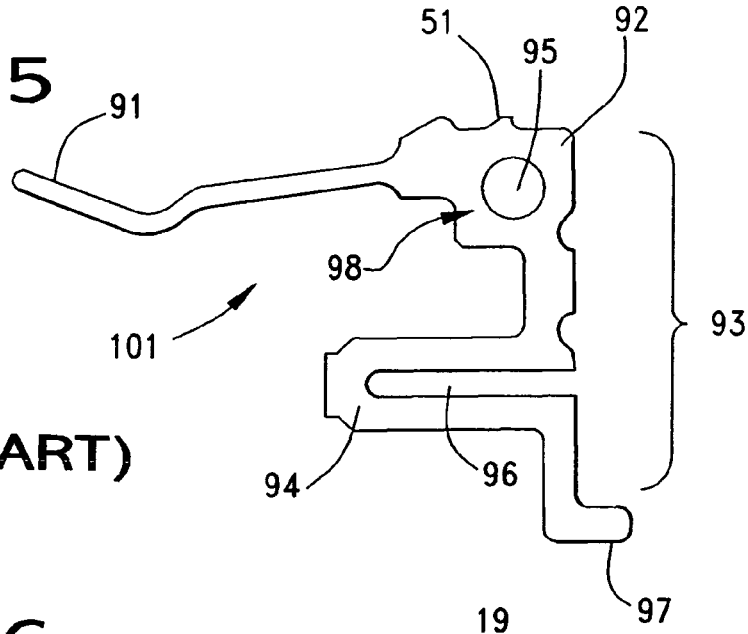
FIG. 5 is a side elevational view of a second type terminal utilized in the known connector housing of FIG. 3.

FIG. 5 illustrates a terminal 101 used in the second set (or type) of terminals in connectors of the present invention. The terminal 101 includes an elongated, cantilevered contact portion 91, a first (upper) retention section 92 that is also considered to be part of a terminal body portion 93. A second (lower) retention section 94 is also provided and is spaced apart from the first retention section 92. Both retention sections 92, 94 are disposed on the terminal 101 between the contact portion 91 and the mounting, or tail portion, 97.

The first retention portion 92 includes a relatively large central part 98, which has an opening 95 formed therein. This opening is shown as circular and completely enclosed within the terminal retention area and serves to reduce the metal of the terminal and this particular portion thereof and it also reduces the capacitance of the terminal with respect to any adjoining terminal, by reducing the amount of surface area of the terminal. This reduction of material also increases the inductance of the terminal, which also influences the impedance of the terminal. The reduction of capacitance (or increase in inductance) will in turn, as is known, affect the impedance of the terminal, and of the connector overall in the region from the second terminal contact portion 91 to the mounting portion 97 thereof. The second terminal retention portion 94 also has an opening 96 formed therein and this opening 96 takes the form of a slot that preferably extends from an edge and through a portion of the central area of the second terminal retention portion 94. This slot 96 is not completely enclosed in the retention portion 94 as in the top retention portion. The opening 95 is shown as circular, a variety of other shapes, preferably polygon shapes may be used. The size and shape of this first retention portion 92 may be varied in order to vary the impedance of the system.

Figure 6:
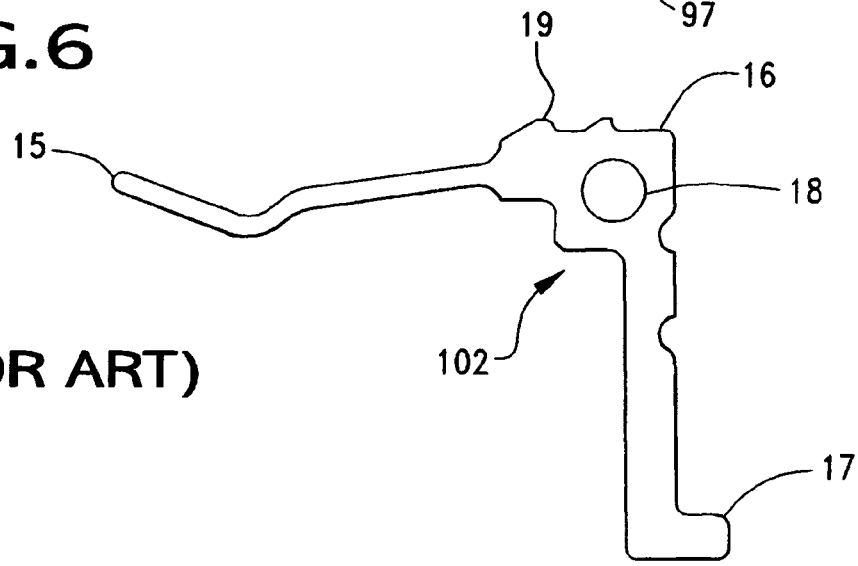
(PRIOR ART) FIG.6
FIG. 6 is a side elevational view of another style of a second type terminal suitable used in the known connector housing of FIG. 3, illustrating another modification of only a single terminal body portion to reduce the overall surface area thereof.

FIG. 6 illustrates another second-type terminal, where the terminal 102 contains a contact section 15, a single retention section 16, and a board mounting section 17. The retention section 16 of this second terminal 102 also contains an opening 18 therein in which metal has been removed from the stamped terminal 102. In the illustrated embodiment, this central portion is substantially circular, but can also take a variety of shapes. The size and shape of this central portion can be varied in order to vary the impedance of the system. The retention section of the second terminal may contain barbs 19 which are used to embed in the slots of the dielectric housing to provide terminal retention. The size of the board mounting portion 17 may also be varied to provide adequate area for mounting to the printed circuit board, while also being tuned to provide a specific impedance in the terminal.

Figure 8:
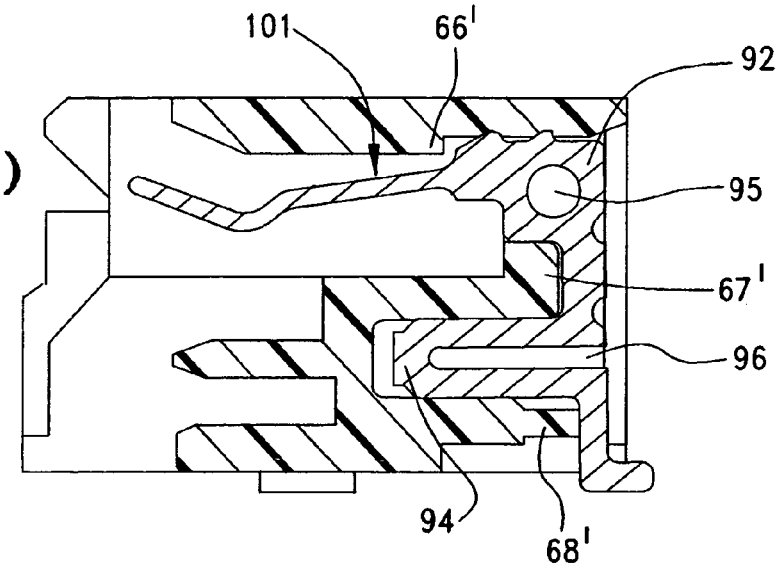
FIG.8 (PRIOR ART)
FIG. 8 is a cross-sectional view of the connector housing of FIG. 3, with a second terminal as shown in FIG. 6, inserted in place within the rear face of the housing.
Figure 9:
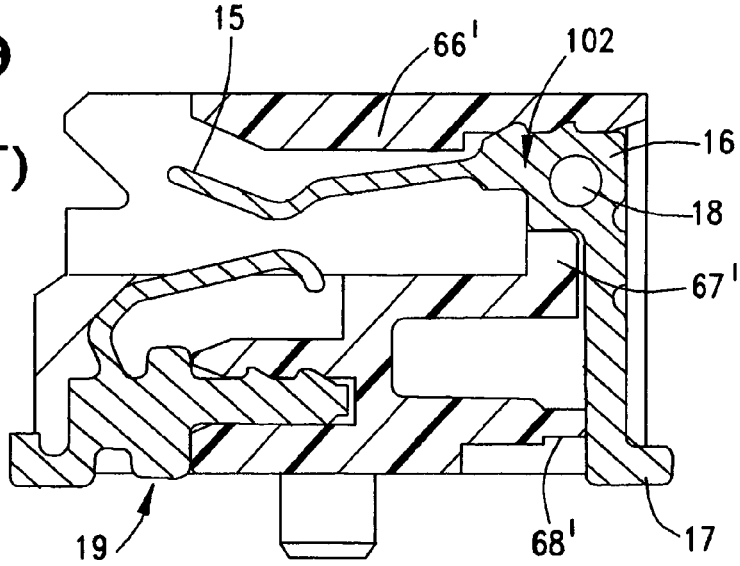
FIG.9 (PRIOR ART)
FIG. 9 is a cross-sectional view of the connector housing of FIG. 3, with a first terminal as shown in FIG. 4 and a second terminal as shown in FIG. 5 inserted therein.

The terminals are easily stamped from sheet metal, but because of the openings 95, 96 formed thereon, a concern is raised about the ability to retain the second terminals 101, 102 within the connector housing 3. This concern is alleviated by modifying the connector housing 3', as illustrated in FIG. 3, in order to provide additional housing material 66', 67' and 68' near the retention slots 90'. The effect of this additional material is shown in FIGS. 8 & 9, where the material 66' and 67' enclose and abut the enlarged terminal first retention portion 92 and in effect, provide additional reaction surfaces against which the retention portions 92, 94 bear. FIG. 9 illustrates how the other second terminal of FIG. 3 is fit into the housings 3' of the invention.

Figure 7:
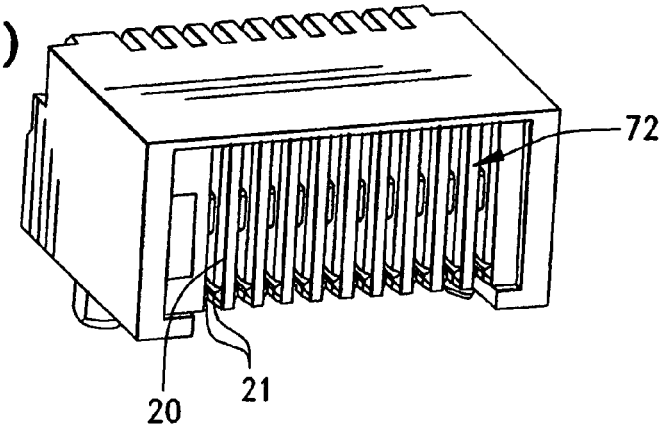
FIG.7 (PRIOR ART)
FIG. 7 is a perspective view of the connector housing of FIG. 3, angled to show the rear face thereof and having the second terminals of FIG. 5 inserted therein.

The length and width of the second retention portion can also be varied in order to vary the surface area of the terminal, and therefore also the impedance. Both first and second retention sections of the second terminal may contain barbs, or teeth 51 which are used to embed the terminals 101 firmly and reliably within the slots 72 of the connector housing 3. The size of the board mounting section may also be varied to provide adequate area for mounting to the printed circuit board, while also being tuned to provide a specific impedance in the terminal. FIG. 7 illustrates the rear face of the connector housing, where each of the terminal receiving slots 72 include a pair of opposing retention bumps 21 disposed on opposite sides of the terminal, for increased terminal retention to the housing.

FIGS. 10-16 illustrate an embodiment of a connector constructed in accordance with the principles of the present invention. In this embodiment, the terminal configuration and arrangement may high speed data signals at speeds of at least approximately 2 gigabits per second and greater up to at least 10 gigabits per second and beyond. It has been found in other connectors, especially those known connectors as exemplified in FIG. 2, that certain structural elements adversely affect the ability to carry high speed signals. Mostly, it is due to at least one of the connector terminals, and such a terminal is shown by the first or front terminal 4. The large surface mount portion 20 thereof adds inductance to the overall impedance of such a connector and thus the terminal 4 must act as a low speed terminal.

Figure 10:
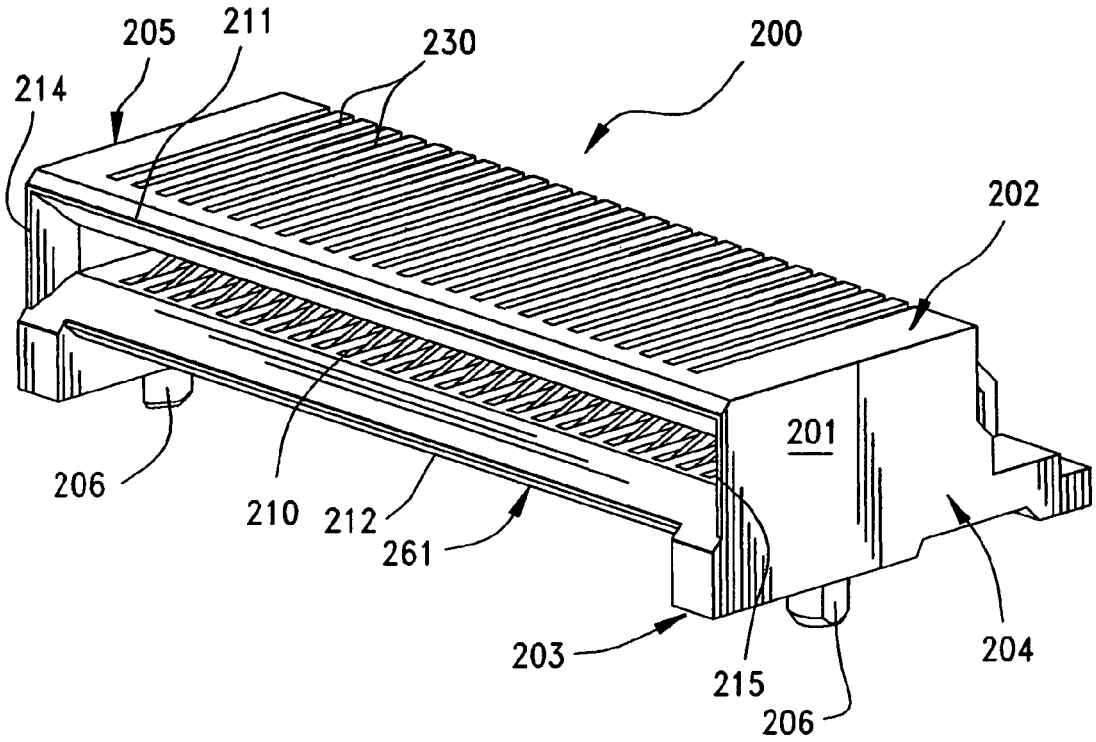
FIG. 10 is a perspective view of a new connector constructed in accordance with the principles of the present invention.
Figure 13:
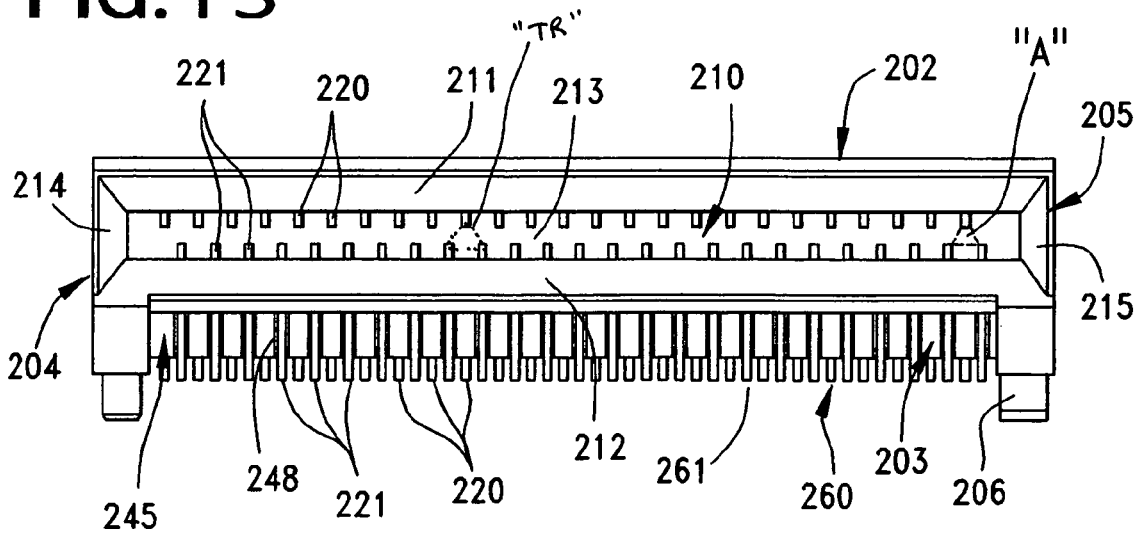
FIG. 13 is a front elevational view of the connector of FIG. 10.
Figure 14:
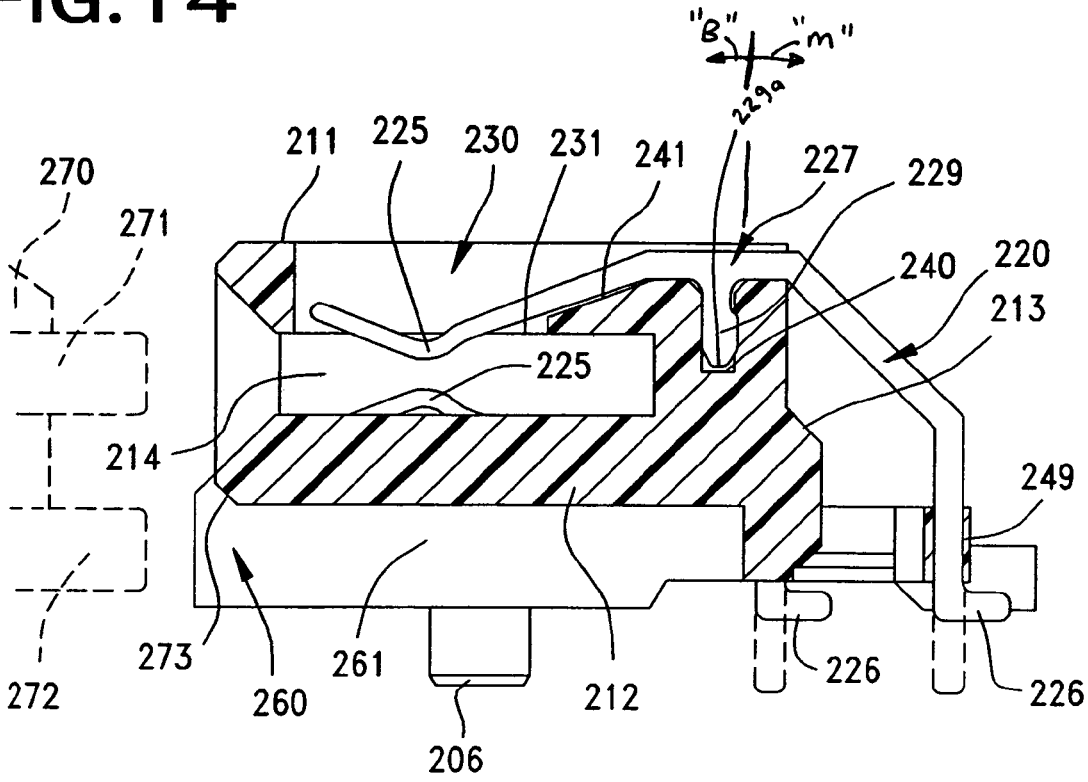
FIG. 14 is a cross-sectional view of the connector of FIG. 10 taken along a line that exposes to view one terminal of the top terminal set of the connector and illustrating its manner of engagement with the connector housing.
Figure 15:
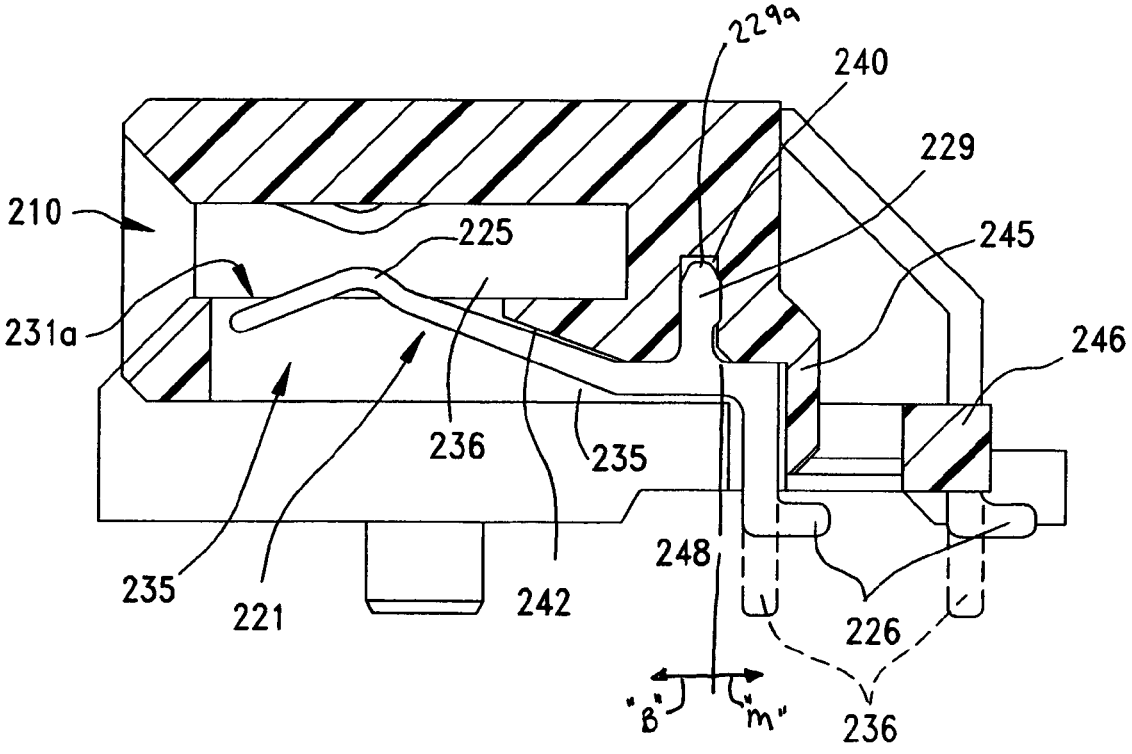
FIG. 15 is a cross-sectional view of the connector of FIG. 10 taken along a line that exposes to view one terminal of the bottom terminal set of the connector and illustrating its manner of engagement with the connector housing.
Figure 16:
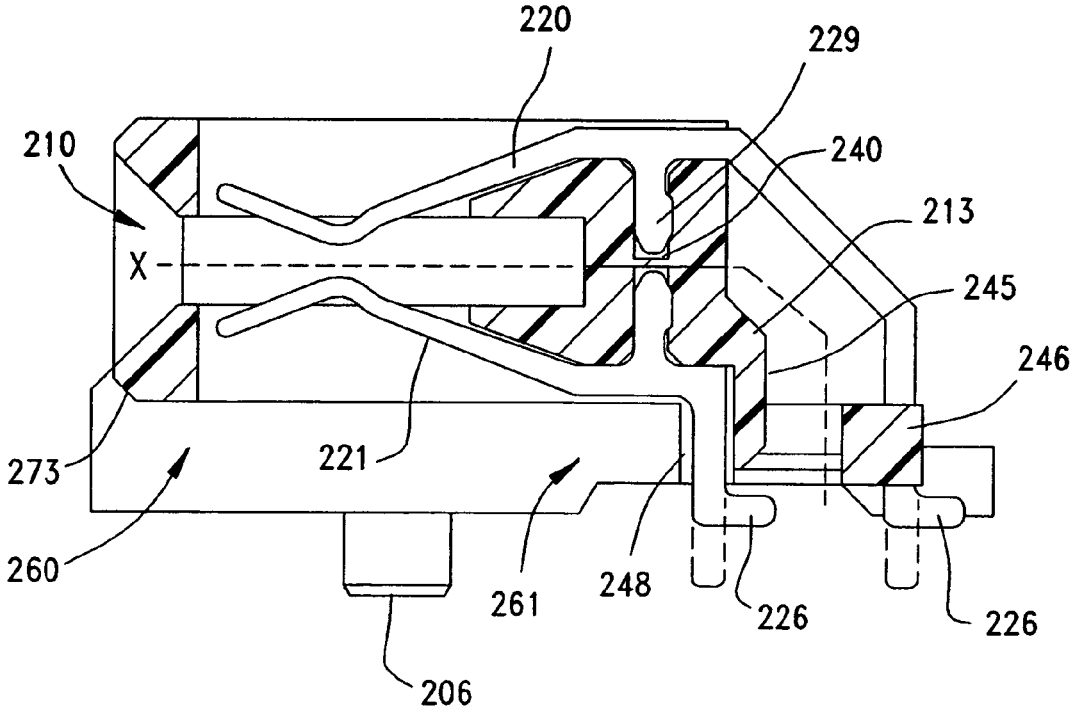
FIG. 16 is a staggered cross-sectional view of the connector of FIG. 10 taken along a line that exposes to view one terminal of each of the top and bottom terminal sets of the connector and illustrating their manner of engagement with the connector housing; and, FIG. 17 is a cross-sectional view of an alternate embodiment of a high speed SFP-style connector which has terminal configurations that are best suited for through hole mounting applications.

The connectors of the present invention provide the ability to carry high speed data signals of 2 Gbps and greater and approaching approximately 10 GBps. As illustrated in FIG. 10, the connector 200 includes a housing 201 that has a top 202, a bottom 203 and two sides 204, 205. The bottom 203 may include one or more mounting posts 206 that are used to position the connector on a circuit board (not shown). The front of the connector preferably includes a circuit card-receiving slot 210 that receives the leading edge of a circuit card that is typically housed within an electronic module (not shown). As shown in FIGS. 14-16, this slot 210 extends interior of the connector housing 201 and is bounded by a top wall 211, a bottom wall 212, a rear wall 213 and two side walls 214, 215. (FIG. 13.)

The connector 200 includes two distinct sets of thin conductive terminals 220, 221 that extend into the card-receiving slot 210 and which provide an electrical transmission path from circuits on the circuit card to circuits on the larger circuit board. The sets of terminals are similar in that they each include contact portions 225 that extend into the card-receiving slot 210 and tail portions 226 that extend out of the connector housing 201 in opposition to the circuit board to which the connector 200 is mounted. The terminals also include what may be considered as body portions 227 that are disposed intermediate the contact and tail portions 225, 226 and which interconnect them together. For purposes of understanding the structure of the present invention, the body portions 227 are considered to end just after where the terminal retention portions extend away from the terminal body portions. The mounting or tail portions of the terminals begin at the same location. This is shown diagrammatically in FIGS. 14 & 15, wherein "B" is represents the end of extent of the terminal body portions and "M" represents the beginning of the extent of the mounting or tail portions of the terminals.

The terminals of the first, or top set, 220 of terminals are inserted into the connector housing 210 in slots 230 that are formed in the top wall 211 of the housing 201. As shown best in FIG. 14, these top slots include openings 231 that communicate with the card-receiving slot 210 of the housing 201 and are positioned so that the contact portions 225 of the top terminal set 220 may at least partially extend into the slot 210. The terminals of the second, or bottom set 221 of terminals are inserted into the connector housing 210 in slots 235 that are formed in the bottom wall 211 of the connector housing 201. As shown best in FIG. 15, these bottom slots 235 include openings 231 that communicate with the card-receiving slot 210 of the housing 201 and are positioned so that the contact portions 225 of the top terminal set 220 may at least partially extend into the slot 210. The terminal-receiving slots 230, 235, as best illustrated in FIG. 13, are offset from each other so that the slots 235 that hold the bottom set of terminals 221 are preferably arranged so that they are positioned offset from the terminals 220 that occupy the top set of slots 230. In this fashion, a triangular arrangement of groups of terminals may be effected, with three terminals being positioned at respective apexes of an imaginary triangle. Such an arrangement is shown in phantom lines in FIG. 13 at "TR" and. it is preferably used in differential signal applications with a pair of differential signal terminals (i.e., two terminals carrying the same magnitude voltage signal, but of different polarities, such as +0.5 volts and −0.5 volts) and an associated ground terminal.

The terminals each further preferably include retention portions 229 (shown as stubs) that primarily serve to retain the terminals in place within the connector housing 201. As illustrated, these terminal retention portions 229 extend at an angle away from the body portions of the terminals and into additional cavities 240 that are formed in the housing 201, and which may be formed, as shown, in the rear wall 212 of the connector housing 201. These additional cavities are offset as between the top and bottom sets 220, 221 of terminals, so that the retention portions 229 of the two terminal sets 220, 221 that are received therein extend toward each other. The free ends 229*a* of the retention portions are preferably spaced from each other a preselected distance so as to obtain a desired capacitive coupling therebetween.

These retention portions 229 support the terminals 220, 221 in a cantilevered fashion, and the terminal slots 210, 211 may be provided with angled faces 241, 242 that extend toward the card-receiving slot 210 and the slot openings 230, 235. In this manner, the contact portions 225 of each of the terminals of the two terminal sets 220, 221 extends in a cantilevered fashion into the card-receiving slot 210. These angled surfaces 241, 242 also serve as reaction surfaces against which the terminals 220, 221 may be bear if the terminal are stitched in the connector housing 201, which would normally occur if the terminals tail portions were of the through hole type (as illustrated in phantom in FIGS. 14-16).

In order to achieve a close terminal to terminal spacing within the card-receiving slot 210, the bottom set 221 of terminals is preferably inserted from the bottom of the connector housing 201. This is achieved without the connector housing losing any significant structural integrity. The main retention of the terminals 220, 221 occurs at the rear wall 212 of the connector housing card-receiving slot 210 and secondary retention is provided by the terminal slots 230, 235.

Although terminal tail portions 226 of the surface mount type are described in detail herein, it will be understood that the connectors of the present invention may also utilize terminals having tail portions of the through hole type 236 as shown in phantom in FIGS. 14-16. Whatever the type of tail portions used for the terminals, it is desired to hold them in position with respect to each other. Rather than employ a separate tail alignment element, the present invention utilizes two different areas of the bottom side 203 of the connector housing 201 to hold the terminal tails 226 in place in a spaced-apart arrangement. The terminal tails 226 are spaced apart from each other lengthwise of the connector 200 and the tails 226, as illustrated in the Figures, are spaced apart along two tail alignment or holding areas 245, 246.

Figure 12:
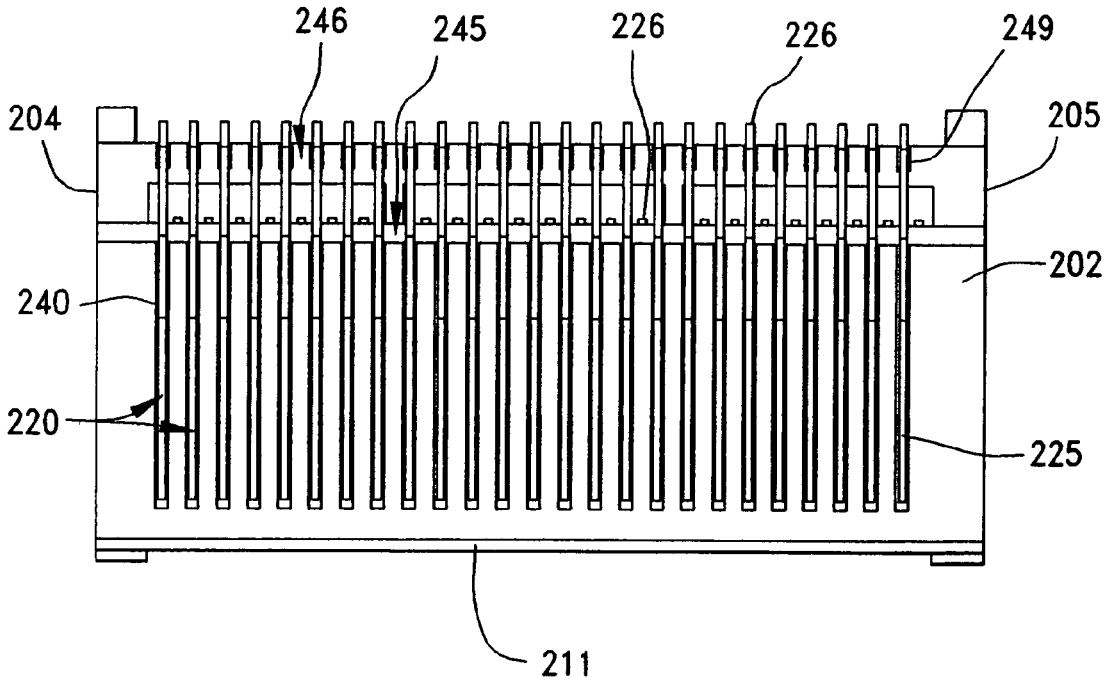
FIG. 12 is a top plan view of the connector of FIG. 10.
Figure 11:
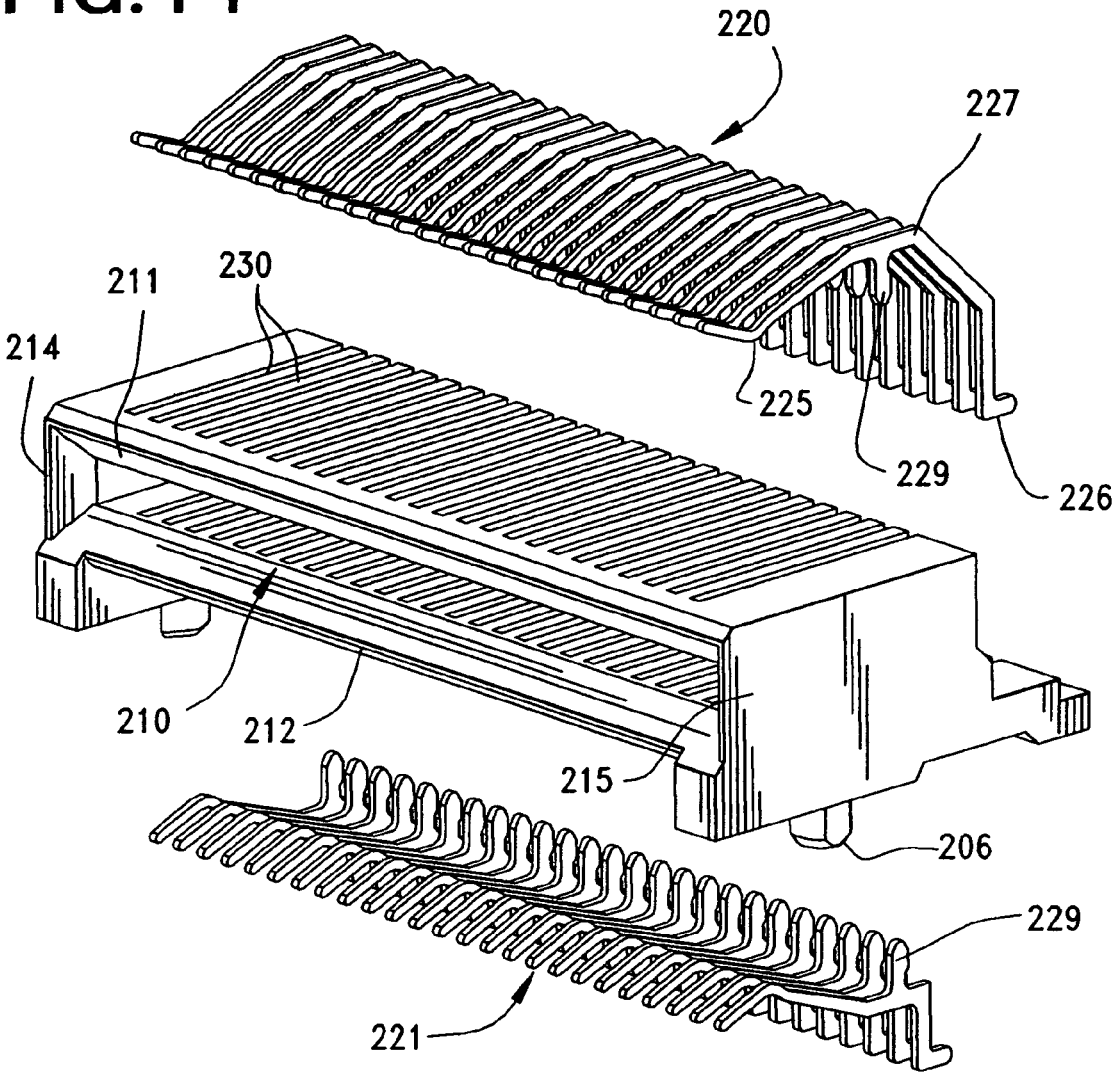
FIG. 11 is an exploded view of the connector of FIG. 10.

Also, as illustrated in FIGS. 12 and 14, the tail portions of the two sets of terminals are provided in two different dielectric mediums so as to further influence coupling between the terminals. As shown, the bottom set of terminals 221 have their tail portions enclosed within slots formed in the bottom of the connector housing. The effect of this is to provide a dielectric medium of the housing material between adjacent tail portions of those terminals. The tail portions of the top set of terminal 220 are seen to be substantially supported with only air as the dielectric medium between them.

As such, different coupling between the adjacent tail portions of the top and bottom terminal sets may be obtained, permitting the impedance of the connectors of the invention to be more finely tuned in the tail portion areas. The shorter length terminals, i.e., the bottom terminals, are enclosed in the plastic of the housing, while the longer length terminal, i.e., the top terminals, are enclosed air. This also permits the connector tail portions to be visually inspected during and after the connectors are soldered to a circuit board. Another impedance tuning aspect is obtained by the arrangement of the two sets of terminal tail portions. The vertical centerlines of the tail portions of the bottom set of terminals is spaced a first distance away (behind) from the vertical centerline of the bottom terminal retention portions and the vertical centerlines of the tail portions of the top terminals are spaced a second distance from the vertical centerline of the top terminal retention portions that is greater than the first distance. Typically, this second distance will be twice that of the first distance.

These areas include a plurality of tail slots 248, 249, with one set of the slots 248 being arranged so that they face the front of the connector, and the other set of slots being arranged so that they face the rear of the connector 200. The slots 248 also open to the bottom of the connector as shown best in FIGS. 13 & 15, while the slots 249 open to the top of the connector as best shown in FIGS. 12 & 14. It can be seen from FIG. 16 that the terminals 220, 221 of the two terminal sets exhibit a measure of symmetry in that they are generally spaced-apart from each other a common distance along a center dividing axis shown in dashed line at X-X. Additionally, the retention portions 229 of each of the terminal sets 220, 221 extend toward each other and are of a small size, so that their stub nature does not create a large impedance discontinuity in this area of the connector terminals so that the impedance may be controlled along the extent of the terminals through the connector housing. The use of this symmetry permits the use of high speed terminals in an application that has size constraints.

It will be understood that the structure of the present invention provides unique advantages. The tail portions of the terminals near the bottom portion of the connector housing serve to anchor the terminals when an opposing mating blade or card is inserted into the connector. It can be seen that the tail portions of the top set of terminals will undergo compression as the free ends of the contact portions of the top terminals 220 are moved upwardly, causing a moment around the top terminal retention portions 229. Similarly, insertion of a card or blade into the connector slot causes the contact portions of the bottom set of terminals to move downwardly, applying a moment around the bottom terminal retention portions 229. This exerts a tensile force on the tail portions of the bottom set 221 of terminals. The application of these two different and opposing forces, reduces any concern that repeated insertions and removals of the mating connector will adversely apply any detrimental torsional forces to the terminal tail portions.

Figure 17:
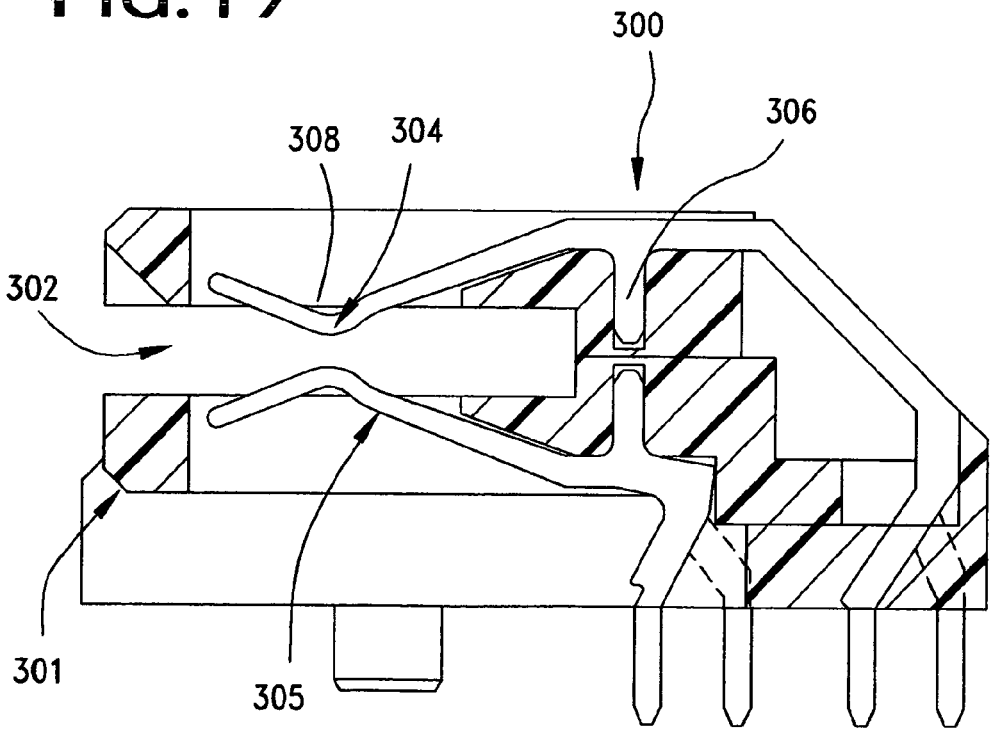

Turning now to FIG. 17, a through-hole embodiment 300 is illustrated in cross-section. As shown, this embodiment 300 has an insulative housing 301 with a card slot 302 that extends width wise across the face 303 of the connector housing 301. Two sets of terminals 304, 305 are utilized and are inserted into the connector housing from the top and bottom surfaces thereof as in the connector 200. The terminals have retention portions 306 that fit into cavities to retain the terminals in place and to provide a reaction surface for the cantilevered terminal contact portions 308. The tail portions 309 of the terminals 394, 305 are angled and offset as shown to provide the through hole feature. A thin web of housing material separates the top and bottom terminals as shown.

While the preferred embodiment of the invention have been shown and described, it will be apparent to those skilled in the art that changes and modifications may be made therein without departing from the spirit of the invention, the scope of which is defined by the appended claims.

The invention claimed is:

1. A connector for providing a connection between a circuit board and a circuit card, the circuit board having a plurality of conductive traces disposed thereon and the circuit card including a male portion having a plurality of conductive members disposed thereon, comprising:

an insulative connector housing having a mating face including a receptacle portion extending into the connector housing for receiving the male portion of said circuit card and a mounting face for mounting said connector housing to said circuit board, the receptacle portion extending in parallel relation to the mounting face; and a plurality of conductive terminals supported by said housing, the terminals being arranged in distinct sets of first and second terminals respectively above and below said receptacle portion, the first and second terminals including contact portions for contacting a corresponding conductive member on opposite surfaces of said circuit card, tail portions for mounting said terminals to a circuit board, body portions interconnecting the terminal contact and mounting portions together, and retention portions for retaining the terminal in place with the connector housing, the terminal retention portions being disposed between said terminal contact and terminal mounting portions and said terminal retention portions of said first terminals extending into said connector housing downwardly toward said second terminals, and said terminal retention portions of said second terminals extending into said connector housing upwardly toward said first terminals, said terminal retention portions further being disposed rearwardly of said receptacle portion.

2. The connector of claim 1, wherein said connector housing includes a plurality of first and second cavities, the first cavities receiving the first set of terminals therein and the second cavities receiving the second set of terminals therein, the first cavities being offset from said second cavities so that said contact portions of said terminals of said first terminal set are offset from said contact portions of said terminals of said second terminal set when said connector is viewed from said mating face.

3. The connector of claim 2, wherein each of said first and second cavities includes a third cavity, the third cavities extending vertically in said connector housing with respect to said first and second cavities, said third cavities receiving said retention portions of said terminals therein.

4. The connector of claim 1, wherein terminal contact portions are supported in a cantilevered manner by said connector housing.

5. The connector of claim 1, wherein said first terminals are received in cavities disposed along a top portion of said connector housing and said second terminals are received in cavities disposed along a bottom portion of said connector housing.

6. The connector of claim 3, wherein ends of said retention portions of said first and second terminal sets are spaced apart from each other.

7. The connector of claim 1, wherein said mounting portions of said first set of terminals are spaced apart from their associated retention portions a first distance and said mounting portions of said second set of terminals are spaced apart from their associated retention portions a second distance.

8. The connector of claim 7, wherein said second distance is greater than said first distance.

9. The connector of claim 7, wherein said second distance is twice said first distance.

10. The connector of claim 1, wherein said mounting portions of said first terminal set have a length that is greater than a corresponding length of said mounting portions of said second terminal set.

11. The connector of claim 1, wherein said mounting portions of said second set extend through said connector housing so that areas between adjacent terminals thereof are occupied by material from which said connector housing is made.

12. The connector of claim 1, wherein said mounting portions of said first set extend out of said connector housing so that areas between adjacent terminals thereof are filled with air.

13. The connector of claim 1, wherein insertion of said male portion of said circuit card into said receptacle portion between said first and second terminal set contact portions imparts a compressive force on said mounting portions of said first set of terminals and imparts a tensile force on said mounting portions of said second set of terminals.

14. The connector of claim 1, wherein said receptacle portion is generally parallel to a circuit board to which said connected is mounted.

15. The connector of claim 1, in which said retention portions of said first and second terminals extend vertically into said connector housing in a common plane.

16. A connector for providing a connection between a circuit board and an opposing electronic element, the circuit board having a plurality of conductive traces disposed thereon and the opposing electronic element including a male portion having a plurality of conductive members disposed, on opposite surfaces of the male portion, the connector comprising:

an insulative connector housing having a mating face including a receptacle portion for receiving said opposing electronic element male portion therein and a mounting face for mounting said connector housing to said circuit board;

a plurality of conductive terminals supported by said housing, the terminals being arranged in distinct sets of first and second terminals on opposing faces of said connector housing, the first and second terminals including contact portions for contacting corresponding conductive members of said opposing electronic element male portion, mounting portions for mounting said terminal to a circuit board, body portions interconnecting the terminal contact and mounting portions together, and retention portions for retaining the terminal in place with the connector housing, the terminal retention portions extending away from the terminal body portions at a location intermediate said terminal contact and terminal mounting portions and into said connector housing from opposite directions with respect to said housing receptacle portion, said terminal contact portions being supported within said connector housing in a cantilevered manner, said mounting portions of said first and second terminals being disposed adjacent a common side of said connector housing; and said retention portions of each of said first and second terminals extending vertically from said terminal body portions into said connector housing from opposite directions rearwardly of said receptacle portion.

17. The connector of claim 16, wherein said retention portions of said first set of terminals extend vertically downwardly within said connector housing and said retention portions of said second set of terminals extend vertically upwardly within said connector housing, and ends of said retention portions of said first and second terminal sets are spaced apart from each other.

18. The connector of claim 16, wherein said mounting portions of said first set of terminals are spaced apart from their associated retention portions a first distance and said mounting portions of said second set of terminals are spaced apart from their associated retention portions a second distance.

19. The connector of claim 16, in which said retention portions of said first terminals extend into said connector housing in laterally offset relation to the retention portions of said second terminals.

20. The connector of claim 16, in which said connector housing has a rear side opposite said mating face and a top side opposite said mounting face, and said mounting portions of said first and second terminals are disposed adjacent said rear side of said connector housing.

21. The connector of claim 20, in which said mounting portions of said first terminals are disposed in a first row, and said mounting portions of said second terminals are disposed in a second row different from said first row.

22. The connector of claim 21, in which said first and second rows of terminal mounting portions are disposed at different distances from said rear side of said connector housing.

23. The connector of claim 21 in which said first and second rows of terminal mounting portions are parallel to each other.

24. A right angle edge card connector for providing a connection between a circuit board and an edge card comprising:

an insulative connector housing having a front mating face including a receptacle for receiving an end of an edge card therein and a bottom mounting face for mounting said connector housing to said circuit board, said insulative housing having a rear side in opposing relation to said front mating face and a top side in opposing relation to said bottom mating face; and a plurality of conductive terminals supported by said housing, said terminals being arranged in distinct sets of first and second terminals, said first and second terminals including contact portions for contacting an edge card inserted into said housing receptacle, the contact portions of said first terminals contacting one surface of the edge card and the contact portions of said second terminals contacting an opposite surface of said edge card, tail portions adjacent the mounting face of said connector housing for mounting said terminals to a circuit board, body portions interconnecting the terminal contact and tail portions together, and retention portions for retaining the terminals in place in the connector housing, said retention portions of the first and second terminals extending respectively from said first and second terminal body portions into said connector housing, and said terminal retention portions of said second terminals extending from said second terminal body portions into said connector housing wherein insertion of said edge card into said receptacle between said first and second terminal contact portions imparts a compressive force to said tail portions of one of said first and second sets of terminals and imparts a tensile force to said tail portions of the other of said first and second sets of terminals from opposite directions at a location rearwardly of said housing receptacle.

25. The connector of claim 24, in which said retention portions of said first and second terminals extend into said connector housing in a common plane.

26. The connector of claim 25, in which said retention portions of said first terminals extend into said connector housing in laterally offset relation to the retention portions of said second terminals.

27. The connector of claim 24, in which said mounting portions of said first and second terminals are disposed adjacent said rear side of said connector housing.

28. The connector of claim 27, in which said mounting portions of said first terminals are disposed in a first row, and said mounting portions of said second terminals are disposed in a second row different from said first row.

29. A right angle edge card connector for providing a connection between a circuit board and an edge card comprising:

an insulative connector housing having a front mating face including a receptacle slot for receiving an end of an edge card and a bottom mounting face for mounting said connector housing to said circuit board, said insulative housing having a rear side in opposing relation to said front mating face and a top side in opposing relation to said bottom mounting face; and a plurality of conductive terminals supported by said housing, said terminals being arranged in distinct sets of first and second terminals, said first terminals being disposed above said housing receptacle slot and said second terminals being disposed below said housing receptacle slot, said first and second terminals including contact portions for contacting an edge card inserted into said housing receptacle slot, tail portions for mounting said terminals to a circuit board, body portions interconnecting the terminal contact and mounting portions together, and retention portions extending toward each other from opposite vertical directions and all of said tail portions of said first and second terminals being disposed adjacent a common side of said connector housing.

30. The connector of claim 29 in which said mounting portions of said first and second terminals are disposed adjacent said rear side of said connector housing.

31. The connector of claim 30 in which said mounting portions of said first terminals are disposed in a first row, and said mounting portions of said second terminals are disposed in a second row different from said first row.

32. The connector of claim 29, in which said first and second rows of terminal mounting portions are disposed at different distances from said common side of said connector housing.

33. The connector of claim 29, in which said terminal mounting portions are surface mountable on the circuit board, and said mounting portions of the first terminals are at least partially disposed within said connector housing and the mounting portions of said second terminals extend at least partially outside of said housing.

34. The connector of claim 33 in which said mounting portions of said first terminals are completely enclosed within said connector housing.

35. A right angle edge card connector for providing a connection between a circuit board and an edge card comprising:

an insulative connector housing having a front mating face including a card slot for receiving an end of an edge card and a bottom mounting face for mounting said connector housing to said circuit board, said insulative housing having a rear side in opposing relation to said front mating face and a top side in opposing relation to said bottom mounting face; and a plurality of conductive terminals supported by said housing, said terminals being arranged in distinct sets of first and second terminals, said first and second terminals including contact portions for contacting opposing surfaces of an edge card inserted into said card slot, tail portions adjacent the mounting face of said connector housing for mounting said terminals to a circuit board and arranged along one side of said connector housing mounting face, body portions interconnecting the terminal contact and mounting portions together, and retention portions formed on the terminal body portions for retaining the terminal in place in the connector housing, said terminal retention portions of the first and second terminals extending vertically from opposite sides of said card slot and engaging said connector housing rearwardly of said card slot.

36. The connector of claim 35, in which said retention portions of said first terminals being supported in said housing in laterally offset relation to the terminals of said second set.

37. The connector of claim 35, in which said terminal retention portions of the first terminals extend into said connector housing from the top side of the connector housing, and said terminal retention portions of said second terminals extending into said connector housing from the bottom mounting face of the connector housing.

38. The connector of claim 35, in which said mounting portions of said first and second terminals are disposed in respective first and second rows adjacent said rear side of said connector housing.

* * * * *